United States Patent [19]

Kobatake et al.

[11] Patent Number: 4,786,341

[45] Date of Patent: Nov. 22, 1988

[54] METHOD FOR MANUFACTURING CONCRETE STRUCTURE

[75] Inventors: Katsuro Kobatake, Sayama; Hideo Katsumata, Kawaguchi; Kensuke Yagi, Yokohama; Tsuneo Tanaka, Yokohama; Tatsuo Ando, Yokohama, all of Japan

[73] Assignees: Mitsubishi Chemical Industries Limited, Tokyo; Ohbayashi Corporation, Osaka, both of Japan

[21] Appl. No.: 38,702

[22] Filed: Apr. 15, 1987

[30] Foreign Application Priority Data

| | | | |
|---|---|---|---|
| Apr. 15, 1986 | [JP] | Japan | 61-85056 |
| Apr. 15, 1986 | [JP] | Japan | 61-85057 |
| Apr. 15, 1986 | [JP] | Japan | 61-85058 |
| Apr. 15, 1986 | [JP] | Japan | 61-86757 |

[51] Int. Cl.[4] ..... B29C 53/56; B29C 63/04; B65H 81/00; E04H 9/02

[52] U.S. Cl. ..... 156/71; 52/167; 52/309.17; 52/653; 52/724; 52/725; 52/DIG. 7; 156/172; 264/32; 264/35; 264/137; 264/263

[58] Field of Search ..... 264/35, 136, 137, 263, 264/32; 156/172, 173, 175, 71; 52/167, DIG. 7, 222, 514, 309.17, 653, 724, 725

[56] References Cited

U.S. PATENT DOCUMENTS

| | | | |
|---|---|---|---|
| 3,316,337 | 4/1967 | North | 264/314 X |
| 3,340,115 | 9/1967 | Rubenstein | 156/172 X |
| 3,551,237 | 12/1970 | Cox et al. | 264/317 X |
| 3,617,414 | 11/1971 | Wesch | 156/172 X |

FOREIGN PATENT DOCUMENTS

| | | | |
|---|---|---|---|
| 0078938 | 6/1981 | Japan | 264/137 |

*Primary Examiner*—Jan H. Silbaugh
*Assistant Examiner*—Karen D. Kutach
*Attorney, Agent, or Firm*—Oblon, Fischer, Spivak, McClelland & Maier

[57] ABSTRACT

A method for manufacturing a concrete structure such as columns and beams with sufficient reinforcement in the shear strength to be durable against earthquakes, etc. A reinforcing member composed of a fiber-reinforced plastic is applied onto the outer periphery of a concrete structural member by winding the fiber strands around the outer periphery of the concrete structural member while impregnating the fiber material with a resin.

8 Claims, 3 Drawing Sheets

METHOD FOR MANUFACTURING CONCRETE STRUCTURE

BACKGROUND OF THE INVENTION

1. Field of the Invention

This invention relates to a method for manufacturing a concrete structure. More particularly, it is concerned with a method for manufacturing a concrete structure whereby, in particular, existing concrete structural members such as columns or beams are reinforced in their shear strength.

2. Discussion of Background

Various existing building structures require reinforcement against earthquake, because they were constructed under old design standards and instructions, and thus are inferior in their aseismatic performance. Or, such aseismatic reinforcement is required for the sake of increasing the number of storeys of the building at the time of extending and/or remodeling the existing buildings.

As the representative method for the reinforcement against earthquake according to the conventional technique, it has been proposed to enclose the existing column members with steel plates or to envelope such existing column members with welded metal nets or reinforcing steel cages, in an attempt to improve toughness of the column members in the main, i.e. in an attempt not to reduce the loading capability and the energy absorbing capability, even when such structural elements are subjected to damage such as cracks, etc. to some extent.

This reinforcing method, however, unavoidably necessitates the welding work of the steel plates at the construction site, and in order to obtain the desired reinforcement, the welding work must be done by skilled welders.

Further, it is usual to pour mortar between the existing column members and the steel plates, welded metal nets, or reinforcing steel cages to attain transmission of stress between them. However, it has been difficult to fill such mortar compactly and densely between them.

Moreover, with the above described reinforcing method, it is common that slits are formed at the end portions of the reinforcing members such as steel plates to increase the shear strength alone of the existing column members, while retaining the bending strength of the reinforcing members to be the same as before the reinforcement. With such measures, however, it is inevitable that, at such slitted portions, the structural members exposed to the environment have poor water-tightness against rain. Consequently, a trouble of leakage of water is likely to occur.

Further, with the reinforcing method using steel plates, it is necessary to apply rust-preventing treatment to the steel plates, which adds to the maintenance cost.

Furthermore, the conventional way of applying the reinforcing member to the concrete structural member has another disadvantage such that when cracks are formed in the concrete structural member, stress tends to concentrate on the reinforcing member in the vicinity of locations where such cracks are formed in the concrete structural member, since both the concrete structural member and the reinforcing member are integrally connected by various adhesives. As a result, the reinforcing member is likely to break at a stage when the cracks are still small in size (width), whereby it is impossible to utilize the strength of the reinforcing member to the fullest extent.

A spirally reinforced column made of reinforced concrete material has so far been assembled in such a manner that a reinforcing steel wire is spirally wound from one end to the other end of the intended structural member. According to this method, the spiral reinforcing steel wire is fixed to the end portions of the structural member where the stress is large and the plastic deformation concentrates.

If, instead of the spiral reinforcing steel wire, a flexible reinforcing member such as a reinforcing fiber, is wound around the structural member in accordance with the above method, such plastic deformation concentrates at the end portions of the structural member as mentioned above, and fixing of the fiber on the structural member deteriorates with a consequent reduction in the stress occurred in the axial direction of the fiber. Since the fiber can hardly bear a stress in a direction other than the axial direction, the reinforcing effect with the fiber will then be extremely small.

On the other hand, it may be contemplated to extend the fiber in the direction of its winding so that it is fixed at another storey of the building instead of at the end portions of the structural member. According to this method, however, the reinforcing fiber inevitably passes through a junction of the column and the beam, where a large stress concentration occurs, and it becomes difficult to maintain the structural performance properly at this junction of the column and the beam. In addition, it is usual in the building construction that the work itemization and the process control of the construction work are planned for each and every storey, so that, when the work in one storey should extend to another storey (such as fixing of the fiber reinforcing material at another storey), such would bring about restriction to the management and control in the construction work.

The present inventors have previously proposed a method of reinforcing a column, in which a long fiber strand having high mechanical strength is spirally wound on the column member (Japanese Patent Application Nos. 273357/1984 and No. 109267/1985). This method lets the high strength long fiber strand as the reinforcing member have a function as a spiral hoop for the reinforced concrete column, from which both effects of increase in the strength of the column and improvement in its toughness can be expected. It has, however, been found that, when cracks are created in the concrete of the column member which has been reinforced by this method, and the strand is broken as a result of the concentration of stress on the fiber strand situated in the vicinity of the cracks, the binding force of this strand becomes abruptly lowered, and the reinforcing effect will be considerably reduced.

Also, in the course of further researches and experiments on the above described method of reinforcement, the present inventors have found also that the cracks start in the column member from its upper end where it is joined with the beam, or from its lower end where it is joined with the floor; that, when the long fiber strand for reinforcement wound around such portion of the column member is broken at the initial stage, the reinforcing effect of the fiber strand as a whole becomes considerably reduced; and that the mortar which covers the outer surface of the column member tends to scale off at the initial stage of the earthquake, and, in this case, if the pitch for winding the fiber strand is large, it is difficult to effectively bind the coarse aggregate beneath the mortar, whereby the coarse aggregate falls off together with the mortar, and no adequate reinforcing effect can be obtained.

It has also been found out that, since the fiber strand is wound around the structural member (column) in a spiral form, it is not possible to obtain sufficient binding force of the fiber strand at both upper and lower ends of the column, where the winding direction of the reinforcing material is reversed, and that, at both the beginning and the end of winding of the fiber strand, it is impossible to transmit a high tension to the fiber strand.

SUMMARY OF THE INVENTION

With a view, therefore, to solving the disadvantages inherent to the conventional methods for reinforcing the concrete structural member, the present inventors have made strenuous efforts, and as a result, they have found that winding work can easily be performed by winding a reinforcing fiber around the outer periphery of the concrete structural member, in the state immediately after it is impregnated with a resin, and the aseismatic reinforcement of the concrete structural member can be realized with good efficiency. Based on this discovery, they have arrived at the present invention.

It is therefore a primary object of the present invention to provide a method for effecting the aseismatic reinforcement on the concrete structural member in a simple and guaranteed manner.

The present invention provides a method for manufacturing a concrete structure comprising a concrete structural member and a reinforcing member of a fiber-reinforced resin provided on the outer periphery of the structural member, which comprises winding a reinforcing fiber around the outer periphery of the concrete structural member while impregnating a resin to the fiber.

The method of the present invention preferably has the following additional features:

(i) An insulating member is interposed in a non-adhered condition between the concrete structural member and the reinforcing member.

(ii) The reinforcing fiber is wound around the concrete structural member in a double spiral fashion, the one spiral being in the right upward direction and the other spiral being in the right downward direction, and the fiber is mutually bonded together at each intersection of the double spirals.

(iii) The reinforcing fiber is wound around the outer periphery of the concrete structural member in a spiral form, and the winding is started from the center portion of the concrete structural member to one end thereof, after which it is turned and continuously wound to the other end of the structural member, thereafter, it is again turned and wound, and finally the starting end and the terminal end of the reinforcing fiber are joined together to complete the winding work.

(iv) At the time of winding the reinforcing fiber in a spiral form, it is wound around the concrete structural member in at least a single winding turn in the direction orthogonal to the axis of the structural member at the winding start and winding end, and at both upper and lower end portions of the concrete structural member.

(v) At the time of winding the reinforcing fiber in a spiral form, both upper and lower winding ends of the reinforcing member are spaced apart by about 5 to 15 mm from both upper and lower ends of the structural member, respectively, and the winding pitch of the reinforcing fiber is set to be smaller than the maximum particle size of coarse aggregate constituting the concrete structural member.

The foregoing objects, other objects as well as specific construction and function of the method for manufacturing the concrete structure according to the present invention will become more apparent and understandable from the following detailed description thereof, when read in conjunction with the accompanying drawing.

BRIEF DESCRIPTION OF THE ACCOMPANYING DRAWING

DETAILED DESCRIPTION OF PREFERRED EMBODIMENT

In the following, the present invention will be described in more detail.

The concrete structural member to be used in the present invention may be a concrete structural member such as a column or a beam in the ordinary existing reinforced concrete structures or existing steel-framed and steel-bar-reinforced concrete structures (so-called SRC). The method of the present invention is particularly effective for reinforcing the shear strength of a concrete structural member made of reinforced concrete which usually has an insufficient amount of the shear reinforcing steel bars.

As the reinforcing member composed of the fiber reinforced plastics material, conventional fiber-reinforced plastics may be used. For example, composite materials of resins reinforced with carbon fiber, glass fiber, etc. are preferable from the standpoint of their light weight. For the fiber material for the reinforcement, those having high mechanical strength and high elasticity are particularly preferred because they are effective for suppressing the expansion of cracks occurred in the concrete structural member.

There is no particular restriction as to the resin to be used, provided that it may be used for the production of the fiber-reinforced plastics. In general, an epoxy resin is used preferably.

According to the present invention, the reinforcing member made of the fiber-reinforced plastics is wound around the outer periphery of the concrete structural member. It is important that such reinforcing member should be shaped in a required form by impregnating the resin in the fiber material immediately before the winding work, and then be wound around the outer periphery of the concrete structural member.

By such a method, it becomes possible to impregnate the resin into the fiber without failure. In this way, the fiber can be wound around the structural member in its flexible state before curing of the impregnated resin, whereby it conforms to the surface of the structural member, and it is possible to give sufficient aseismatic reinforcement to the concrete structural member in a simple and guaranteed manner.

In the following, the present invention will be explained with reference to several practical embodiments shown in the accompanying drawings.

Figure 1:
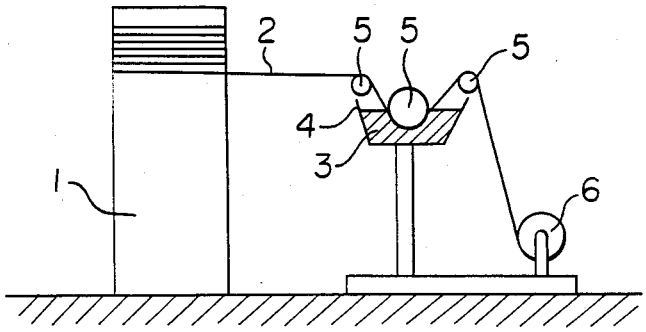
FIG. 1 is a schematic view illustrating the method of the present invention.

Referring to FIG. 1 which shows schematically one embodiment of practicing the method for manufacturing the concrete structure according to the present invention, reference numeral 1 designates a concrete structural member, numeral 2 refers to a reinforcing fiber, numeral 3 refers to a resin, reference numeral 4 denotes a resin impregnating vessel (bath), reference numeral 5 represents guide rollers, and numeral 6 indicates a bobbin.

The fiber 2 is drawn out of the bobbin 6, and follows a path defined by the guide rollers 5, during which it is dipped into the resin impregnating bath 4 where it is sufficiently impregnated with the resin 3. After this, the resin impregnated fiber is wound around the outer periphery of the concrete structural member 1, and, in its wound state, the resin is cured to thereby complete the aseismatic reinforcement.

While the winding of the reinforcing member may be done by use of a machine, it may also be carried out manually depending on the position on the concrete structural member where the reinforcement is to be effected, or on the working environment.

After the winding, the reinforcing member is pressed to expand the fiber in a tape form having a certain large breadth. In so doing, the contact area of the reinforcing member increases, which relaxes the stress concentration, and delays the breakage of the reinforcing member, with the consequence that the aseismatic reinforcement can be favorably and effectively completed.

It is preferred to apply a pretreatment to the outer periphery of the concrete structural member by application of an epoxy type prime-coating material, whereby the adhesion between the reinforcing member and the concrete structural member improves, and the reinforcing strength favorably increases.

Also, when an insulating member is interposed in a non-adhesive manner between the reinforcing member and the outer periphery of the concrete structural member, the stress concentration onto the reinforcing member due to cracks occurred in the concrete structural member can be relaxed, because there is no direct adhesion between the concrete structural member and the reinforcing member with the consequence that the deformability of the concrete structural member can be favorably improved.

There is no particular restriction as to the insulating member, provided that it may produce sliding between the concrete structural member and the insulating member, or between the insulating member and the reinforcing member, or both, when it is interposed between the concrete structural member and the reinforcing member. Examples of such insulating member are cellophane, a polyester film, a teflon film and oil paint. These materials may, of course, be selected appropriately from those which do not bring about the bonding due to the chemical reaction among these three, i.e. the concrete structural member, the reinforcing member, and the insulating member, by taking into consideration the nature of the reinforcing member and its relationship with the concrete structural member.

Such insulating member, may be applied onto the concrete structural member by winding, sticking, or other expedients, over which the reinforcing member is further applied in the same manner. It is important to note, at this point, that these three members be maintained in a non-adhered state so that they may not stick together. It is also possible that in case an inorganic long fiber such as carbon fiber or glass fiber is used as the reinforcing member, the fiber is coated or impregnated beforehand with a resin, and then applied onto the concrete structural member with the insulating member interposed therebetween, after which the resin is cured.

In this case, the above-mentioned concrete structure is in such situation that since the insulating member is present between the concrete structural member and the reinforcing member in a non-adhered state, even when an external force is exerted to the concrete structure and cracks form, the cracks do not propagate directly to the reinforcing member nearest to them, but propagate to the entire reinforcing member, whereby elongation of the reinforcing member will be small. As the result, until such time as the reinforcing member reaches the limit of its elongation, it will not be broken, which permits the reinforcing member to sufficiently exhibit its capability of absorbing the external force, that is, the energy absorbing capability.

In the method according to the present invention, when the reinforcing member is to be wound around the concrete structural member, it may be preferable that the reinforcing member is wound in a double spiral fashion around the existing concrete column, for example, the one spiral in the right upward direction and the other spiral in the right downward direction, and the fiber strand of the reinforcing member is mutually bonded together at each intersection of the two spirals.

Figure 2:
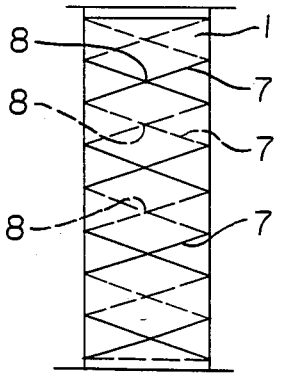
FIG. 2 is an explanatory diagram illustrating the method for aseismatic reinforcement of an existing concrete column according to the present invention.

Referring to FIG. 2, reference numeral 1 designates an existing column (concrete structural member), on which a high strength long fiber strand (reinforcing member) 7 is spirally wound in the right upward direction as far as the upper end of the column with the center portion of the column as the starting point of the winding. Then, at this upper end, the reinforcing member is turned to continue its spiral winding in the right downward direction to the lower end of the column. At this lower end of the column, the reinforcing member is again turned to be spirally wound in the right upward direction to the center part of the column where the terminal end of the strand and the above-mentioned starting end thereof are bonded together with an adhesive.

For this high strength long fiber strand 7, there may be used a fiber strand in which about 6000 carbon fiber monofilaments are bundled and impregnated with a resin. The number of the filaments may suitably be adjusted.

According to the present invention, the fiber strand 7 wound in the double spiral fashion with one spiral in the right upward direction and the other spiral in the right downward direction, is connected at each intersection 8 by an adhesive, as mentioned above.

The adhesion of the fiber strand at each intersection 8 may be done simply in such a manner that, after the fiber strand 7 is wound in the double spiral fashion, an adhesive such as an epoxy resin is applied only to these intersections. Otherwise, an uncured resin is impregnated beforehand to the fiber strand 7 which is then wound in the double spiral fashion around the structural member so that the intersections of the strand may be integrally connected by the impregnated resin.

Further, according to the method of the present invention, the high strength long fiber strand is wound in the double-spiral form on the existing concrete column, the one spiral in the right upward direction and the other spiral in the right downward direction, and then the fiber strand is mutually bonded at each intersection. Consequently, even when cracks are generated in the concrete structural member and the stress concentrates on the strand in the neighborhood of the cracks to rupture it, since the fiber strand is wound in the double spiral fashion, either one of the spirals in the right upward direction and in the right downward direction, remains unbroken. This unbroken spiral of fiber strand is able to bear the stress. Further, the breakage of the strand at one point thereof gives influence on only a limited narrow portion of the strand, while the fiber strand of other major portion can retain the same binding force as ever. Therefore, very excellent aseismatic reinforcement effects can be exhibited without suffering from considerable decrease in the effect of reinforcement.

Furthermore, since no steel material is used, there is no necessity for the rust-preventing treatment, nor welding work. Also, since no slit is formed at both upper and lower ends of the column, there is no apprehension of reduced water-tightness against rain.

Moreover, at the time of winding the reinforcing material according to the method of this invention, it is preferable that the starting point of the winding of the reinforcing member is set at the center portion of the column and/or beam (concrete structural member), and the winding is continued to one end of the structural member, where the reinforcing fiber strand is turned and continued its winding to the other end thereof. Again the reinforcing fiber strand is turned and wound, and finally the starting end and the terminal end of the reinforcing fiber strand joined together to complete the winding work.

FIGS. 3 to 7 illustrate one embodiment of winding the reinforcing member on the concrete structural member. The winding step as shown in each Figure represents a case wherein the method is applied to reinforcement of an existing cylindrical or polygonal concrete column 1 (concrete structural member) piercing through a ceiling 9*a* and a floor 9*b* at an arbitrary storey of a building.

Figure 3:
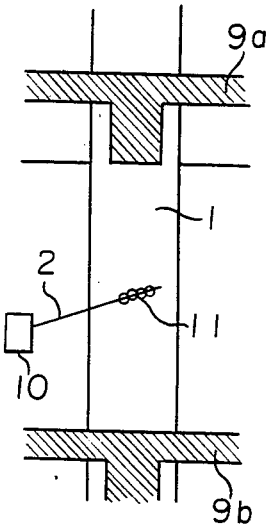
FIGS. 3 to 7 are respectively side elevational views showing in sequence the process steps of carrying out the method of winding the reinforcing member according to the present invention.

Firstly, as shown in FIG. 3, the starting end of the reinforcing member 2 drawn out of a roll 10 is fixed on the center portion of the column 1. Since this work is effected for fixing the reinforcing member 2 during its expansion, a fixing point 11 of the reinforcing member on the center portion of the column 1 may have such a strength that is able to secure fixation of the reinforcing member 2.

In case the reinforcing member 2 is made of a fiber material, the fixing point 11 may be adhered to the column with a resin. On the other hand, when the reinforcing member is made of metal wire or metal strand, a jig such as metal fittings may be used for joining.

Figure 4:
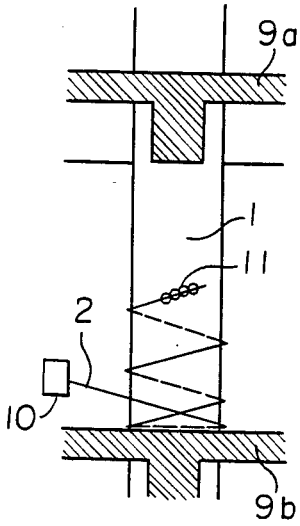
Figure 5:
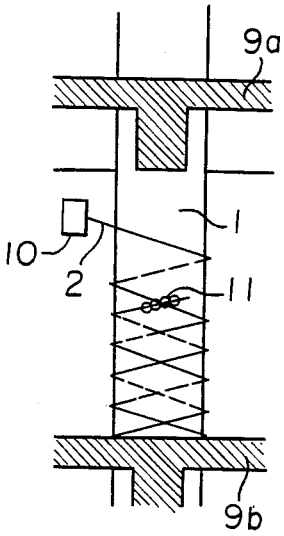
Figure 6:
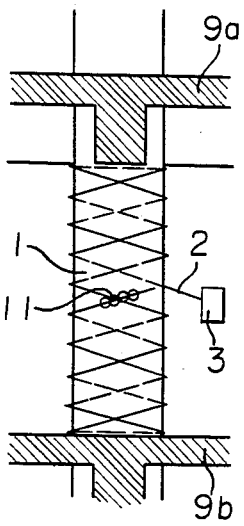
Figure 7:
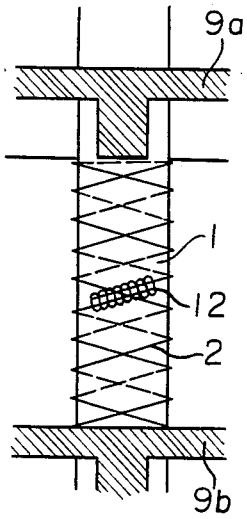

Then, the reinforcing member 2 is wound around the outer periphery of the column 1, while drawing the same out of the roller 10, in which case the reinforcing member 2 is first wound in the direction toward the floor, as shown in FIG. 4, and when the winding has reached the lower end of the column 1, the reinforcing member is turned and wound continuously toward the upper end of the column, as shown in FIG. 5. When the winding has reached the top end of the column, the reinforcing member is turned and continuously wound to the center part of the column, as shown in FIG. 6. Finally, as shown in FIG. 7, the starting end and the terminal end of the reinforcing member 2 are joined together to complete the winding work. As the method for connecting both ends at their connecting point 12, in case the reinforcing member is made of fiber material, the two ends may be bonded together with a resin adhesive, and in case it is made of a metal wire or metal strand, there may be adopted a mechanical joining method by use of a jig such as metal fittings for joining. It is necessary that this connecting point 12 has ample room for its joining strength so as not to bring about any breakage at this connecting point 12.

In the above described method for winding the reinforcing member, structurally excellent result as well as favorable reduction in the material cost can be realized by densely winding the reinforcing member at both upper and lower end portions of the column 1, and by sparsely winding the same at the center portion of the column.

Also, in the above described method of execution, the winding work can be completed in a single step on one and the same storey. In this case, the spiral reinforcement can be completed precluding the complicated connection between the column and the beam where the reinforcement with dense winding is required. Furthermore, in the spirally reinforced column obtained by this method, the fixing point of the fiber is at the center portion where the stress conditions are relatively relaxed, and the fixed state of the reinforcing member is satisfactory. Also, the reinforcing effect can be displayed sufficiently due to winding of the reinforcing member in a spiral form. Yet, since the reinforcing member is bound together at intersections of spirals, the stress bearing capability of the reinforcing member is not deprived of, whereby the binding effect of the concrete structural member can also be maintained, which is the characteristic feature of the spirally reinforced column.

Moreover, since the double spiral system is adopted, i.e., the concrete structural member is reinforced in the so-called "double spiral fashion", the reinforcing effect is also more excellent to some extent than the single spiral reinforcement, provided that the amount of reinforcement is same.

Also, owing to the fact that the concrete structure as obtained by the method of the present invention has the connecting point of the reinforcing member at its portion where the stress concentration is small, and that, even when damage is caused to the concrete structure, such connection of the reinforcing member is maintained perfectly, it is possible to secure the required strength and toughness of the concrete structure even under very vigorous and severe conditions such as heavy earthquake or others.

In the following, explanations will be given as to the method of obtaining the concrete structure, wherein, at the time of spirally winding the reinforcing member such as a high strength long fiber strand around the concrete structural member such as an existing concrete column, the above-mentioned strand is wound in at least a single winding turn in the direction orthogonal to the axis of the column at the start and the end of the winding work and at both upper and lower end portions of the column.

Figure 8:
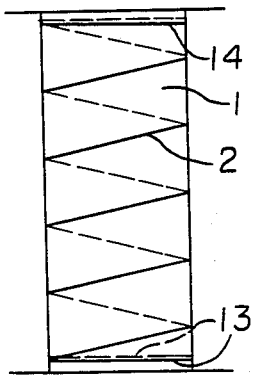
FIGS. 8 and 9 are also schematic side elevational views for illustrating different methods of the aseismatic reinforcement according to the present invention.

Referring to FIG. 8, numeral 1 refers to the existing column, on which is wound the high strength long fiber strand 2 in a spiral form with the bottom end thereof as the starting point. At the start of this winding operation, the strand 2 is first wound in a single winding turn around the outer periphery of the column 1 in the direction orthogonal to the axis of the column 1 to thereby form a hoop 13. After its starting end is bonded to the hoop 13 by an adhesive, the strand 2 is spirally wound toward the upper end of the column 1. When it has reached the upper end of the column 1, the strand is again wound in a single winding turn in the direction orthogonal to the axis of the column 1 to thereby form a hoop 14, and the terminal end of the strand is bonded to this hoop 14 by an adhesive.

In this manner, since it is possible to spirally wound the reinforcing member around the column 1 by first bonding the starting end of the fiber strand 2 to the hoop 13 and thereby imparting a tensile force to the strand 2 from the beginning, the reinforcing member as wound is free from slackening or loosening, hence it is tightly in contact with the surface of the column 1. Further, since no tensile force is lost by bonding the terminal end of the strand 2 to the hoop 14, it is possible to realize the spiral winding of the reinforcing material free from the slackening or loosening. Furthermore, since the strand 2 is tightly put around the column 1, the column receives a high binding force of the strand 2, whereby sufficient effect of the aseismatic reinforcement can be achieved.

Figure 9:
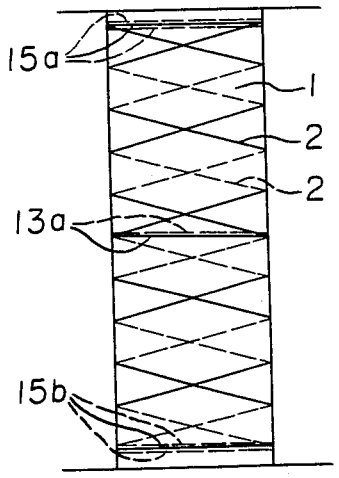

FIG. 9 illustrates another embodiment of the present invention, in which the double-spiral form of the reinforcing members is realized by first winding the fiber strand 2 around the existing column 1 in the spiral form by extending it from the center portion of the column 1 in the right upward direction to the top end of the column, then turning the strand at the top of the column 1 to be continuously wound in the spiral form in the right downward direction to the bottom end of the column 1, and further turning the strand again at this bottom end to be wound in the spiral form in the right upward direction to the center portion of the column. In this embodiment, too, besides forming the hoop 13 of the strand at the start of its winding as is the case with the previous embodiment, to which the starting end of the strand is bonded, other hoops 15*a* and 15*b* are formed in one and half winding turn at the top and bottom ends of the column 1 where the strand is turned "downward" and "upward", respectively. On the other hand, the terminal end of the strand 2 is bonded by an adhesive to the hoop 13*a* which was formed at the position where the winding of the strand started.

In the case of this second embodiment, it is not only possible that the winding of the strand as a whole can be tightened by vigorous tension imparted to a portion of the strand where it tends to be readily slackened at the turn of its winding direction, but also possible to attain another effect such that both top and bottom ends of the column where the stress is likely to concentrate can be reinforced strongly.

As mentioned in the foregoing, the method of the present invention is so constructed that at the time of winding the fiber strand as the reinforcing member in a spiral form, it is wound around the column as the concrete structural member in at least a single winding turn in the direction orthogonal to the axis of the structural member at the beginning and the end of its winding and at both upper and lower end portions of the structural member. On account of this, it is possible to effect the tight winding, while imparting a strong tensile force to the reinforcing member successively from the beginning to the end of its winding, whereby there accrues a particularly excellent effect such that both upper and lower ends of the structural member where the stress concentration is prone to take place especially can be reinforced more strongly than any other parts of the structural member.

Further, it is preferable that at the time of spirally winding the high strength long fiber strand around the existing concrete column, the wound ends of the strands be spaced apart from the respective ends of the column by a distance of from 5 to 15 mm, and the winding pitch of the strand is set at a value smaller than the maximum particle size of the coarse aggregate constituting the existing column.

Figure 10:
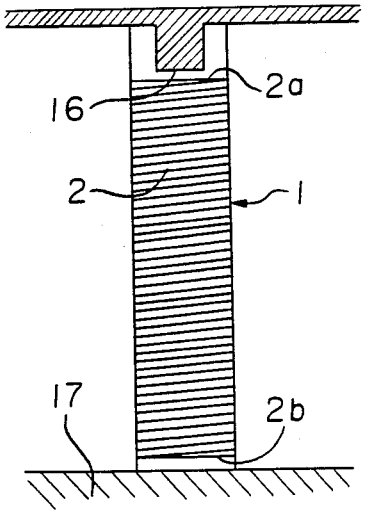
FIG. 10 is an explanatory diagram illustrating another embodiment of the aseismatic reinforcement of a column according to the present invention.

In FIG. 10, reference numeral 1 designates the existing concrete column, on which the high strength long fiber strand 2 is spirally wound. The top end 2*a* and the bottom end 2*b* of this strand as wound are respectively spaced apart by a distance of from 5 to 15 mm from the top end of the column which is joined to the beam 16 and from the bottom end of the column which is joined to the floor 17. The reasons for not winding the strand 2 up to the top and bottom ends of the column are 1) that the joined portion of the column with the beam and the floor can be sufficiently reinforced without necessity for winding the strand to the top and bottom ends of the column and 2) that the place where cracks are first generated in the structural member at the time of heavy earthquake is the joined portion between the column and the beam or the floor, and if these portions are covered with the strand as wound, the reinforcing member 2 at these portions is broken at the initial stage of the earthquake due to the stress concentration generated at the cracked portion to become unable to exhibit the sufficient reinforcing effect. Also, the reason for having the end of the reinforcing member as wound on the concrete structural member spaced apart from both top and bottom ends of the column by a distance of from 5 to 15 mm is that, if the distance is less than 5 mm, the fiber strand may possibly fall into the breadth of the cracks at both top and bottom ends of the column, and if the distance exceeds 15 mm, the fiber strand will be unable to sufficiently bind the concrete structural member at the portion where the structural member is joined with the beam and the floor.

Further, according to the method of the present invention, the pitch for winding the fiber strand 2 is made smaller than the maximum particle size of the coarse aggregate constituting the column 1. The reason for this is that, when a heavy earthquake happens, a large number of fine cracks are brought about in the mortar around the column at the initial stage to become exfoliated, at which time, if the winding pitch of the strand 2 is greater than the grain size of the coarse aggregate, the aggregate which is not bound by the fiber strand falls with the surrounding mortar in a large quantity whereby the reinforcing effect will be substantially reduced. It is preferable that the pitch for winding this strand 2 be about one half or below the maximum particle size of the coarse aggregate. In so doing, there is no possibility of the strand being broken by the cracks generated in the joined portion between the column and the beam or the floor at the initial stage of the heavy earthquake, and the reinforcing effect of the strand can be prevented from remarkably decreasing at the initial stage of the earthquake. In addition, since the above-mentioned fiber strand is wound with the prescribed winding pitch which is smaller than the maximum particle size of the coarse aggregate constituting the existing column, the strand is able to effectively bind the coarse aggregate to bring an excellent reinforcing effect.

Moreover, since no steel material is used, there is no necessity for the rust-preventing treatment, nor the welding work. Further, since no slit is formed in the top and bottom ends of the column, there is no apprehension of leakage of water due to rain.

In the foregoing explanations of the present invention, the reinforcement of the existing column has been taken as an example. It should, however, be noted that the invention is applicable also to the case of the spiral reinforcement of, for example, newly constructed columns, wherein the main steel bars for the column are reinforced in the same manner as described above. It is also applicable to the reinforcement of the beams.

It is desirable to provide a covering of an arbitrary material on the outer surface of the concrete structure which has thus been obtained by the method of the present invention, for the purposes of protecting the reinforcing material and decorating the concrete structure as a whole.

Thus, the present invention provides an easy and guaranteed method for reinforcement in the shear strength of the existing concrete structural member, and is therefore advantageous from the industrial point of view.

Furthermore, according to the present invention, when practicing the reinforcement in the shear strength of the existing concrete structural member, the strength of the reinforcing material can be fully utilized. At the same time, the quantity of the reinforcing member to be used can be reduced. Therefore, it is possible to effect the reinforcement in the shear strength of the concrete structural member at a lower cost than in the conventional techniques.

Although the present invention has been described in the foregoing in specific details with reference to its preferred embodiments, it should be noted that the invention is not limited to these embodiments alone, but any changes and modifications may be made by those persons skilled in the art within the spirit and scope of the invention as recited in the appended claims.

What is claimed is:

1. A method of manufacturing a concrete structure having improved aseismatic performance, comprising the steps of:

impregnating a fiber with a resin;

spirally winding the resin impregnated fiber as a reinforcing member around the outer periphery of an existing elongate concrete structural member while the resin is in an uncured state;

curing the resin; and subjecting the structural member to stress, wherein the spiral winding step is started from the center portion of the concrete structural member and continues to one end thereof, after which the fiber is turned and continuously wound to the other end of the structural member, and thereafter, the fiber is again turned and wound, and finally a starting end and a terminal end of the fiber are joined together to complete the winding step.

2. The method for manufacturing a concrete structure according to claim 1, including the step of pressing the wound reinforcing fiber impregnated with the resin so as to be flattened into a reinforcing member of a tape form.

3. The method for manufacturing a concrete structure according to claim 1, wherein the fiber is one selected from the group consisting of carbon fiber, glass fiber, organic fiber and metal fiber, or a composite material made up of such fibers.

4. The method for manufacturing a concrete structure according to claim 1 including the step of interposing an insulating member in a non-adhered condition between the concrete structural member and the reinforcing member.

5. The method for manufacturing a concrete structure according to claim 1, wherein the spiral winding step comprises sparsely winding the fiber at the center portion of the concrete structural member, and densely winding the fiber at both end portions thereof.

6. The method for manufacturing a concrete structure according to claim 1, wherein at the time of winding the fiber in a spiral form, it is wound around the concrete structural member in at least a single winding turn in a direction orthogonal to the axis of the structural member at the start and end of the winding step, and at both upper and lower end portions of the concrete structural member.

7. The method for manufacturing a concrete structure according to claim 1, wherein the winding step comprises winding the fiber such that both upper and lower winding ends of the reinforcing member are spaced apart by about 5 to 15 mm from both upper and lower ends of the structural member, respectively, and the winding pitch of the fiber is set to be smaller than the maximum particle size of coarse aggregate constituting the concrete structural member.

8. The method for manufacturing a concrete structure according to claim 1, wherein the fiber is wound around the concrete structural member in a double spiral fashion, one spiral being in the right upward direction and the other spiral being in the right downward direction, and the fiber is connected at each intersection of the double spirals.

* * * * *